US008449307B2

(12) United States Patent
Wertz

(10) Patent No.: US 8,449,307 B2
(45) Date of Patent: May 28, 2013

(54) SOCKET CONNECTOR HAVING CONTACT WITH MULTIPLE BEAMS JOINTLY GRASPING BALL OF IC PACKAGE

(75) Inventor: Darrell Lynn Wertz, Chandler, AZ (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/241,306

(22) Filed: Sep. 23, 2011

(65) Prior Publication Data

US 2013/0078829 A1 Mar. 28, 2013

(51) Int. Cl.
*H01R 12/00* (2006.01)

(52) U.S. Cl.
USPC ..... 439/78

(58) Field of Classification Search
USPC ..... 439/78, 70–72, 73, 65, 66, 682
See application file for complete search history.

(56) References Cited

U.S. PATENT DOCUMENTS 5,746,608 A * 5/1998 Taylor ..... 439/70
5,887,344 A * 3/1999 Sinclair ..... 29/843
6,045,416 A * 4/2000 Sinclair ..... 439/857
6,843,662 B2 * 1/2005 Ju ..... 439/83
6,914,192 B2 7/2005 Ju
7,442,045 B1 * 10/2008 Di Stefano ..... 439/66
7,537,461 B2 * 5/2009 Rathburn ..... 439/66
7,695,287 B2 * 4/2010 Smith et al. ..... 439/70
7,771,209 B2 * 8/2010 Chang ..... 439/66
7,857,631 B2 * 12/2010 Cavegn et al. ..... 439/65
8,172,581 B2 * 5/2012 Yeh ..... 439/70

* cited by examiner

*Primary Examiner* — Alexander Gilman

(74) *Attorney, Agent, or Firm* — Wei Te Chung; Ming Chieh Chang

(57) ABSTRACT

A socket connector is provided to receive an IC package having an array of conductive balls thereunder. The socket connector includes an insulative housing defining a plurality of receiving holes and a plurality of contacts received in the receiving holes respectively. Each contact includes a bottom plate and at least two contacting beams extending upwardly from the bottom plate and jointly defining a receiving space for the ball of the IC package. At least one contacting beam has a sharp blade facing toward the receiving space so as to engage the ball when the IC package is mounted on the housing.

17 Claims, 5 Drawing Sheets

SOCKET CONNECTOR HAVING CONTACT WITH MULTIPLE BEAMS JOINTLY GRASPING BALL OF IC PACKAGE

BACKGROUND OF THE INVENTION

1. Field of the Invention

The present invention relates to a socket connector for connecting an IC package, and particularly to a socket connector including a contact having multiple contacting beams for jointly grasp a ball of the IC package.

2. Description of Related Art

U.S. Pat. No. 6,914,192 issued to Ted Ju on Jul. 5, 2005 discloses a socket connector for interconnecting an integrated circuit (IC) package to a mother board. The socket connector includes a socket body with a plurality of contacts received therein. A loading plate is pivotally assembled to one end of the socket body. When the IC package is seated on the socket body, the loading plate is moved downward to securely press the IC package toward the contacts. The contact has an oblique contacting beam extending beyond an upper surface of the housing. When the IC package is loaded, the contacting beam contact the conductive leads under the IC package such that the electrical connection between the IC package and the socket connector is achieved.

However, because the contacting beams of the contacts extend beyond the upper surface of the socket body with a long distance, it results in a large height of the socket connector and thus does not meet the trend of miniaturization. In addition, the contacting beams deflect under pressure and the risk of circuit short between adjacent contacts exists.

In view of the above, an improved socket connector is desired to overcome the problems mentioned above.

SUMMARY OF THE INVENTION

Accordingly, an object of the present invention is to provide a socket connector having a low profile and capable of eliminating risk of short circuit.

According to one aspect of the present invention, there is provided a socket connector for receiving an IC package having an array of conductive balls thereunder. The socket connector includes an insulative housing defining a plurality of receiving holes and a plurality of contacts received in the receiving holes respectively. Each contact includes a bottom plate and at least two contacting beams extending upwardly from the bottom plate and jointly defining a receiving space for the ball of the IC package. At least one contacting beam has a sharp blade facing toward the receiving space so as to engage the ball when the IC package is mounted on the housing.

Other objects, advantages and novel features of the invention will become more apparent from the following detailed description when taken in conjunction with the accompanying drawings, in which:

DETAILED DESCRIPTION OF THE INVENTION

Reference will now be made to the drawings to describe the present invention in detail.

Figure 1:
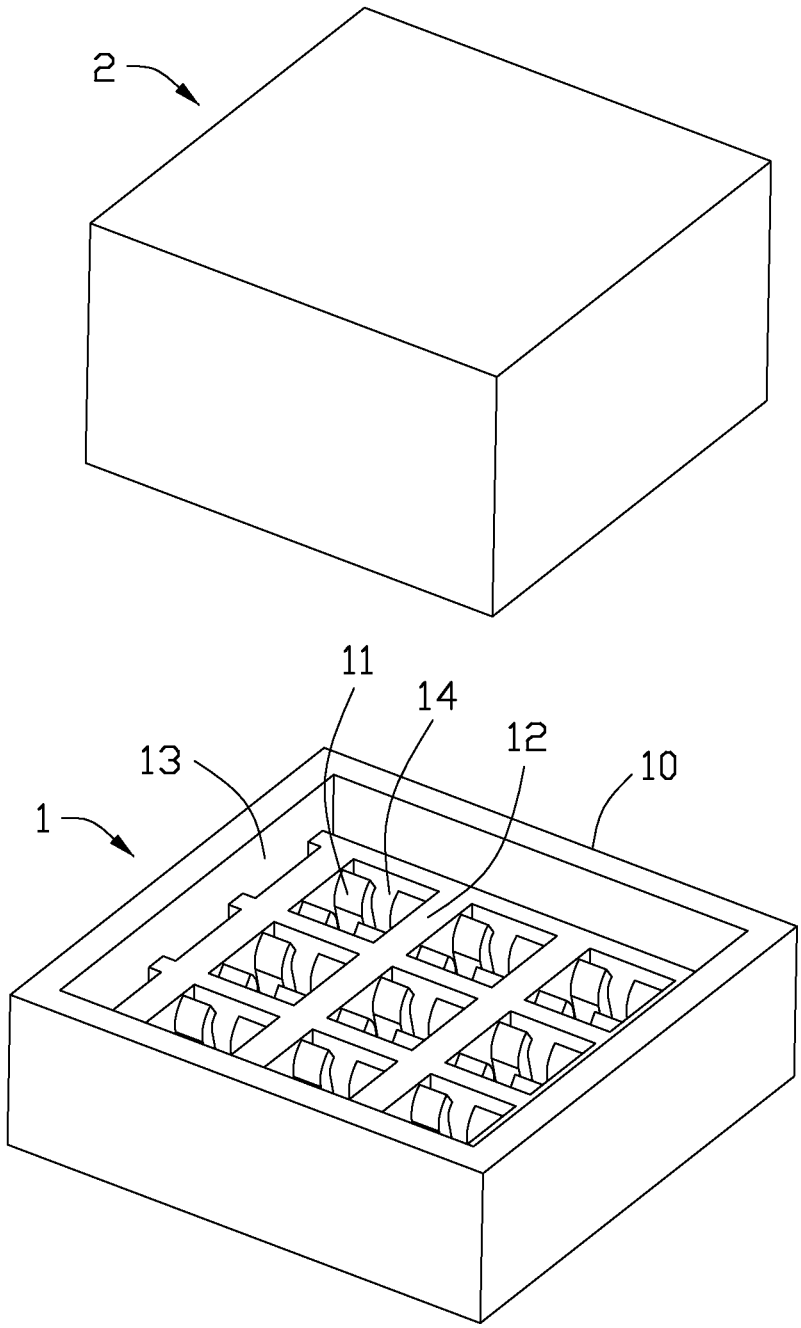
FIG. 1 is a perspective view of a socket connector and an IC package in accordance with a preferred embodiment of the present invention.
Figure 2:
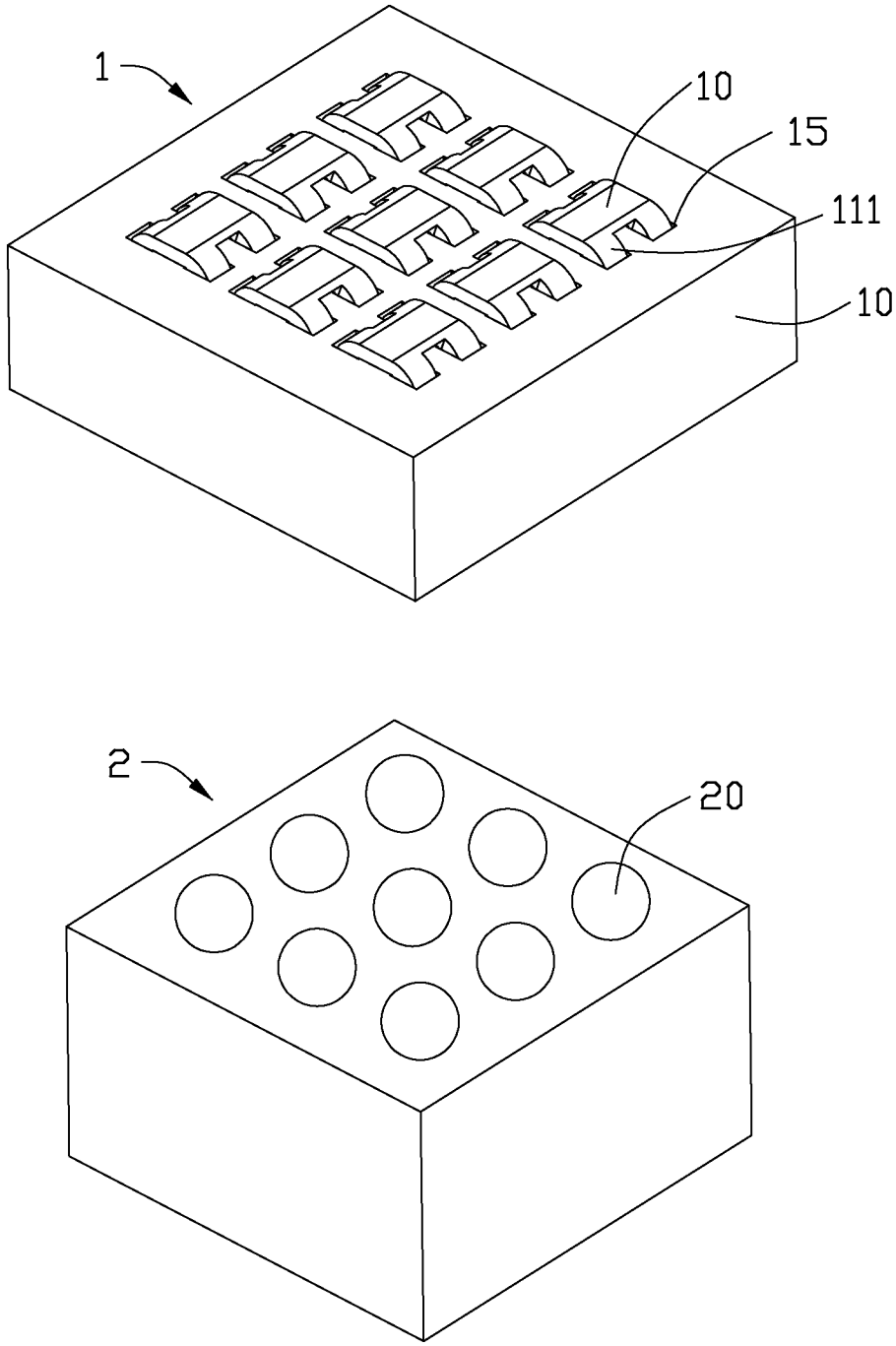
FIG. 2 is another perspective view of the socket connector and the IC package as shown in FIG. 1.
Figure 3:
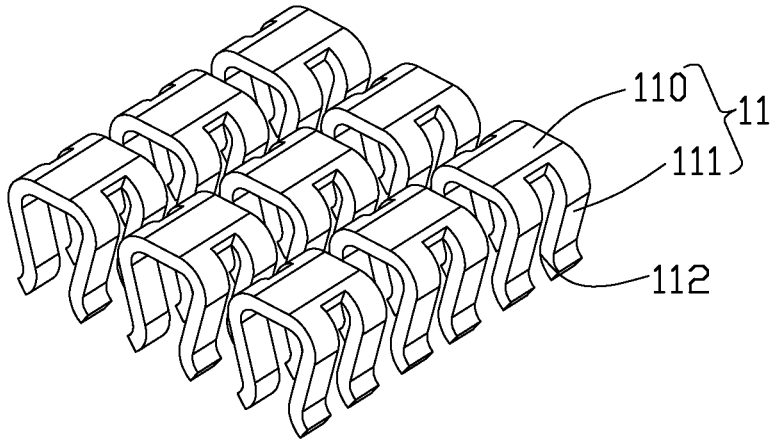
FIG. 3 is an exploded, perspective view of the socket connector as shown in FIG. 1.
Figure 3:
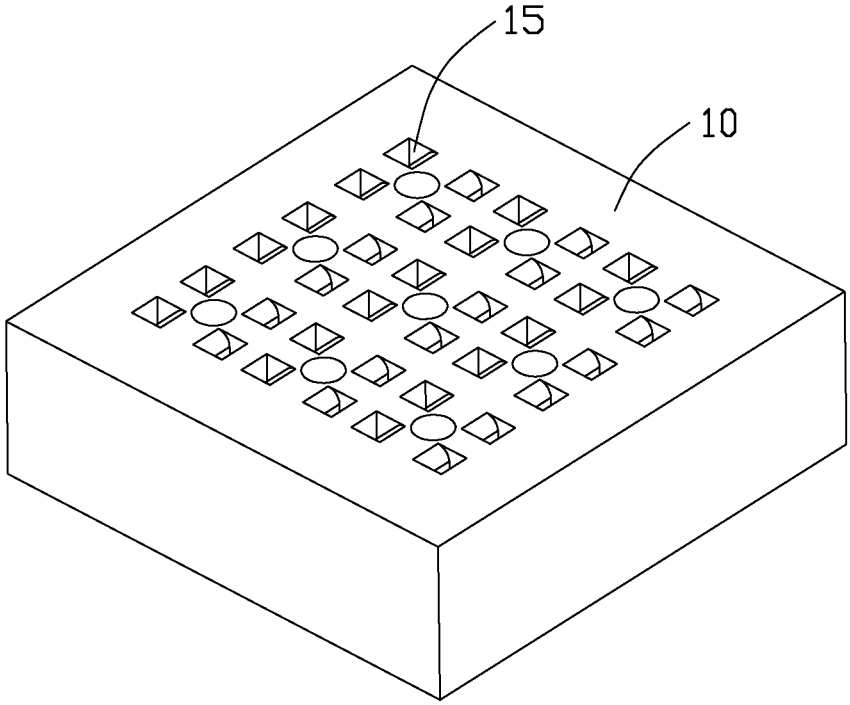

Referring to FIG. 1 to FIG. 3, a socket connector 1 for connecting an IC package 2 is made in accordance with a preferred embodiment of the present invention. The IC package 2 includes an array of conductive balls 20 under a bottom surface thereof. The socket connector 1 includes an insulative housing 10 and a plurality of contacts 11 received in the housing 10. The housing 10 further includes a base 12 and four periphery sidewalls 13 extending upwardly from the base 12. The base 12 is formed with a plurality of receiving holes 14 for respectively receiving the contacts 11 therein. The contact 11 is located under an upper surface of the housing 10.

Figure 4:
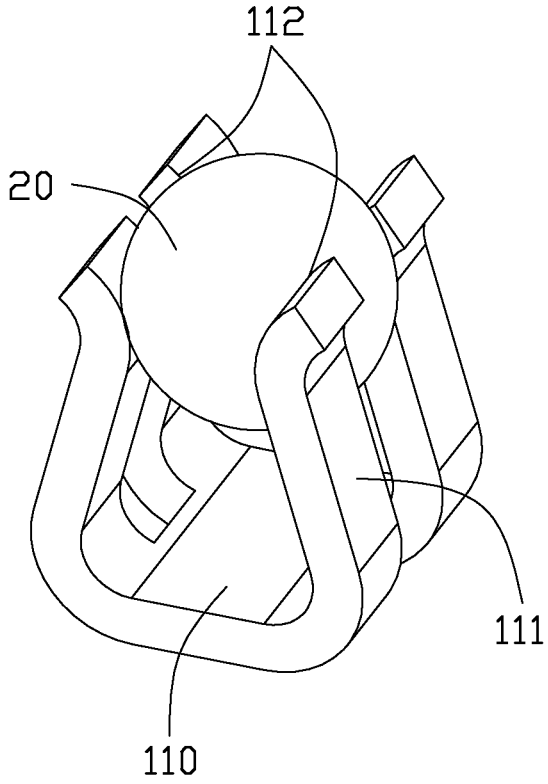
FIG. 4 illustrates a contact of the socket connector grasping a ball of the IC package.
Figure 5:
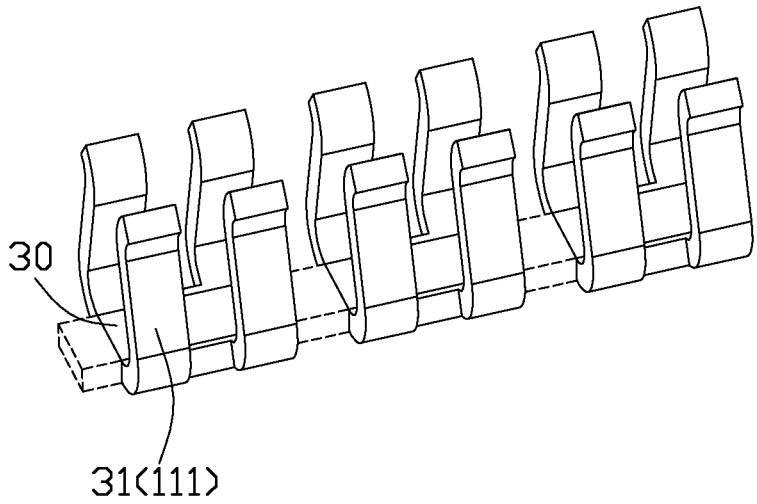
FIG. 5 illustrates a contact strip with lots of individual contacts connected thereto one by one.

Particularly referring to FIGS. 4 and 5, the contacts 11 are mass produced from a metal sheet. A planar metal sheet (not shown) is firstly stamped to form an elongated trunk portion 30 and two rows of branch portions 31 connected to opposite sides of the trunk portion 30. The two rows of branching portions 31 are then bent upward in a same direction relative to the trunk portion 30 to form contacting beams 111 for the contacts 11, respectively. Redundant sections (illustrated with broken line in FIG. 5) of the trunk portion 30 that interconnect two neighboring contacts 11 are finally cut down so as to form lots of individual contacts 11 each having a bottom plate 110 for being soldered onto a printed circuit board and two pair of contacting beams 111 respectively located at a pair of opposite sides of the bottom plate 110. The other pair of sides of the bottom plate 110 are thus formed with linear cutting surfaces (not labeled) due to cutting process. The contacting beams 111 extend upwardly from the bottom plate 110 and jointly define a receiving space (not labeled) for the ball 20 of the IC package 2. Each contacting beam 111 has a sharp blade 112 facing toward the receiving space and engaging the ball of the IC package 20 such that the IC package 2 is securely and reliably connected with the contact 11.

The contacts 11 are upwardly mounted into the housing 10 from a bottom surface of the housing 10. Each receiving hole 14 is configured with four apertures 15 at a bottom position thereof allowing the contacting beams 111 of the contact 11 to pass through, while stopping the bottom plate 110 and preventing upward movement of the contact 11 relative to the housing 10.

The contact 11 according to the present invention is configured such that a low profile of the total assembly including the socket connector 1 and the IC package 2 is achieved. In addition, the contact 11 is cost effective and ready for mass production, and is also able to reliably connect a ball of the IC package 2 due to the blade edge 112 that slightly stabs the ball of the IC package 2. The socket connector 1 according to present invention also reduces risk of short circuit between adjacent contacts 11 due to the contacts 11 being hidden in the base 12 of the housing 10.

While preferred embodiments in accordance with the present invention has been shown and described, equivalent modifications and changes known to persons skilled in the art according to the spirit of the present invention are considered within the scope of the present invention as defined in the appended claims.

What is claimed is:

1. A socket connector for receiving an IC package having an array of conductive balls thereunder, comprising:

an insulative housing defining a plurality of receiving holes; and a plurality of contacts received in the receiving holes respectively, each contact comprising a bottom plate and at least two contacting beams extending upwardly from the bottom plate and jointly defining a receiving space for the ball of the IC package;

wherein at least one contacting beam has a sharp blade edge extending along a direction, which is defined by an extension direction of the contacting beam, and facing toward the receiving space and engaging the ball when the IC package is mounted on the housing.

2. The socket connector as claimed in claim 1, wherein the contact comprises two pairs of said contacting beams receptively located by two opposite sides of the bottom plate, and a pair of said contacting beams located in one side of the bottom plate defines a slot to allow the ball to protrude thereof.

3. The socket connector as claimed in claim 1, wherein the housing comprises a base and a plurality of sidewalls extending upwardly from the base, and the contacts are received within the base.

4. The socket connector as claimed in claim 1, wherein contact is located under an upper surface of the housing.

5. The socket connector as claimed in claim 1, wherein the receiving hole defines a plurality of apertures on the base, and the contacting beams of the contact pass through the apertures respectively, the bottom plate of the contact being stopped under the base.

6. A socket connector mounted on a printed circuit board for receiving an IC package having an array of conductive balls thereunder, comprising:

an insulative housing comprising a base defining an upper surface for mating with the IC package, a lower surface for mating with the printed circuit board, and a plurality of receiving holes extending between the upper and the lower surface; and a plurality of contacts respectively received in the receiving holes, each contact comprising a planar bottom plate extending to the lower surface of the base and soldered onto the printed circuit board and at least two contacting beams directly and upwardly bent from the bottom plate for jointly grasping the ball under the IC package; and wherein the receiving hole defines a plurality of apertures on the lower surface of the base, and the contacting beams pass through the apertures respectively, while the bottom plate is stopped under the lower surface.

7. The socket connector as claimed in claim 6, wherein the bottom plate of the contacts has a pair of linear cutting surfaces opposite to each other.

8. The socket connector as claimed in claim 6, wherein the contacting beam of the contact has a blade edge stabbing the ball of the IC package.

9. The socket connector as claimed in claim 6, wherein the contact is located under the upper surface of the base.

10. The socket connector as claimed in claim 6, wherein the housing further comprises a plurality of sidewalls extending upwardly from the base.

11. A socket connector assembly comprising:

an electronic package equipped with a plurality of conductive balls;

an insulative housing defining opposite upper and bottom surfaces;

a plurality of passageways formed in the housing;

a plurality of contacts disposed in the corresponding passageways, respectively, each of said contacts defining a lower mounting section for mounting to a printed circuit board, and an upper contacting section for contacting a ball of the electronic package, including at least three resilient contacting beams commonly defining a ball receiving cavity to receive the conductive ball of the electronic package therein in a clipping manner; wherein at least two of said at least three resilient contacting beams define a pair of opposite cutting edges respectively intimately abutting against the corresponding conductive ball of the electronic package.

12. The socket connector assembly as claimed in claim 11, further including one additional resilient contacting beam cooperating with the at least three resilient contacting beams to result in two pair of resilient beams with two pairs of cutting edges in a symmetrical manner for surrounding the conductive ball of the electronic package.

13. The socket connector assembly as claimed in claim 12, wherein the mounting section of each of the contacts defines a bottom plate located below a bottom wall of the housing for soldering to the printed circuit board.

14. The socket connector assembly as claimed in claim 13, wherein the bottom wall of the housing defines plural sets of apertures, and each set includes four apertures in the symmetrical manner for passage of the corresponding two pairs of resilient beams.

15. The socket connector assembly as claimed in claim 11, where said at least two of said at least three resilient contacting beams are aligned with each other in a direction, and said opposite cutting edges are opposite to each other in said direction.

16. The socket connector assembly as claimed in claim 11, wherein a center of the corresponding conductive ball is located at center plane between the opposite cutting edges.

17. The socket connector assembly as claimed in claim 11, wherein the cutting edges invade said conductive ball.

* * * * *